United States Patent [19]

Cobb

[11] Patent Number: 4,528,764

[45] Date of Patent: Jul. 16, 1985

[54] SUSPENDED CEILING SIGN

[75] Inventor: Ronald W. Cobb, Atlanta, Ga.

[73] Assignee: Apco Graphics, Inc., Atlanta, Ga.

[21] Appl. No.: 587,150

[22] Filed: Mar. 7, 1984

[51] Int. Cl.[3] ..... G09F 13/00

[52] U.S. Cl. ..... 40/553; 40/558

[58] Field of Search ..... 40/553, 559, 554, 558, 40/570; 362/148, 150

[56] References Cited

U.S. PATENT DOCUMENTS

| | | | |
|---|---|---|---|
| 1,315,187 | 9/1919 | Hotchner | 40/553 |
| 1,545,009 | 7/1925 | Paine | 40/559 |
| 1,788,427 | 1/1931 | Eisenberg | 40/472 |
| 3,052,794 | 9/1962 | Kruger | 362/150 |
| 3,187,174 | 6/1965 | Gerstel et al. | 362/150 |
| 3,974,584 | 8/1976 | Shorette | 40/545 |
| 4,075,775 | 2/1978 | Shorette | 40/553 |
| 4,290,218 | 9/1981 | Drueck, Jr. | 40/553 |
| 4,449,166 | 5/1984 | Sharp | 362/150 |

*Primary Examiner*—Gene Mancene
*Assistant Examiner*—Cary E. Stone
*Attorney, Agent, or Firm*—Jones & Askew

[57] ABSTRACT

A suspended ceiling sign is provided for suspension within a vacant panel area, under a light fixture, in a suspended ceiling of a regular array of ceiling panels with each panel being peripherally supported within a suspended grid structure. The ceiling sign includes a hollow enclosure having an open top with a peripheral flange configured to engage the supporting grid structure around the vacant panel area. The enclosure has in one of its sidewalls a cutout portion with a translucent sign mounted therein. The bottom of the enclosure has a directed lighting aperture. Inside the enclosure, there is a truncated pyramidal baffle which is both light reflective and translucent. The pyramidal baffle is seated over the aperture in the enclosure bottom. The truncated top of the baffle may be either open or closed with a translucent material. Thus, light emanating from the lighting fixture above the suspended ceiling is partly reflected from the baffle face through the translucent sign, and partly diffused through the translucent baffle to light the aperture in the bottom of the enclosure.

8 Claims, 4 Drawing Figures

SUSPENDED CEILING SIGN

BACKGROUND OF THE INVENTION

This invention relates generally to a suspended sign for use with modular suspended ceilings, and relates particularly to such a sign in which the sign indicia may be lighted while providing directed light beneath the sign.

In most modern retail stores, such as department stores, super markets, drug stores and the like, a wide variety of products are typically displayed on a single level of large area. There is a need for highly visible display signs to enable a shopper to visually ascertain the location of a particular product line. Also, there is the necessity of providing for sufficient environmental lighting for effective display of the various products, as well as for lighting the product location signs.

Fluorescent lighting fixture of various types are typically used in conjunction with suspended acoustic tile ceilings. Tubular fluorescent lights are mounted in fixtures disposed above the plane of the suspended ceiling. At these locations, the ceiling tiles are omitted. A translucent diffuser is substituted for these tiles and is generally made flush with the ceiling.

In many such stores there is little relationship between the environmental lighting fixtures and the display signs. Typically, these display signs are entirely separate from the store lighting and either are not illuminated or are provided with a separate light fixture.

Of general interest is the disclosure of U.S. Pat. No. 4,075,775 for "Light Diffuser and Illuminating Ceiling Display" issued Feb. 28, 1978 to Shorette, directed to a suspended ceiling display fixture that serves to diffuse a lighting source and at the same time to illuminate sign indicia. The fixture includes a hollow translucent enclosure having a peripheral flange for suspending the fixture from a vacant panel position in the ceiling under a light source.

Of general interest is the disclosure of U.S. Pat. No. 4,290,218 for "Ceiling Module" issued Sept. 22, 1981 to Drueck, directed to a suspended ceiling display panel module having a relatively increased number of display areas in that the bottom of the fixture has one or more recesses with display indicia.

Additionally, there is a need for a suspended ceiling display module that not only provides for lighting of display indicia but also provides a directed light source beneath the fixture. Such a fixture would be especially useful in public corridors such as office building hallways to provide an attractive lighting impression in addition to illuminating useful display indicia.

SUMMARY OF THE INVENTION

It is an object of the present invention to provide an improved sign display and lighting fixture for use with modular suspended ceilings.

It is another object to provide such a fixture having enhanced illuminating properties with respect to both display indicia and directed lighting.

Accordingly, the invention is directed to a suspended sign designed to be installed immediately below an existing light fixture in a conventional modular suspended ceiling. Flanges surrounding the sign structure engage suspension T-bars of the ceiling. The suspended sign has one or more message display faces. A baffle generally in the shape of a truncated pyramid, within the suspended sign, reflects illumination outwardly to and through each translucent sign face. The baffle is configured such that it also serves as a light diffuser for area lighting. A portion of the light baffle may be open to enhance illumination from the ceiling lighting fixture to the floor area below the suspended sign.

Specifically, there is provided a suspended ceiling sign for suspension within a vacant panel area, under a light source, in a suspended ceiling of a regular array of ceiling panels with each panel being peripherally supported within a suspended grid structure. The sign includes a hollow enclosure having an open top with a peripheral flange configured to engage the grids which delimit the vacant panel area. The sign includes a sign cutout in one of its sidewalls with a translucent sign mounted in the cutout and a lighting aperture in the enclosure bottom. Inside the enclosure there is a reflective and translucent baffle seated around and over the aperture, the configuration of the baffle being substantially pyramidal or conical.

Preferably, the top of the baffle is truncated and optionally may be open or closed at its truncated top. Preferably, the enclosure includes a recess about the aperture and the base of the baffle is configured to seat about the recess.

BRIEF DESCRIPTION OF THE DRAWINGS

Further details are given below with reference to the drawings.

DESCRIPTION OF THE PREFERRED EMBODIMENTS

Figure 1:
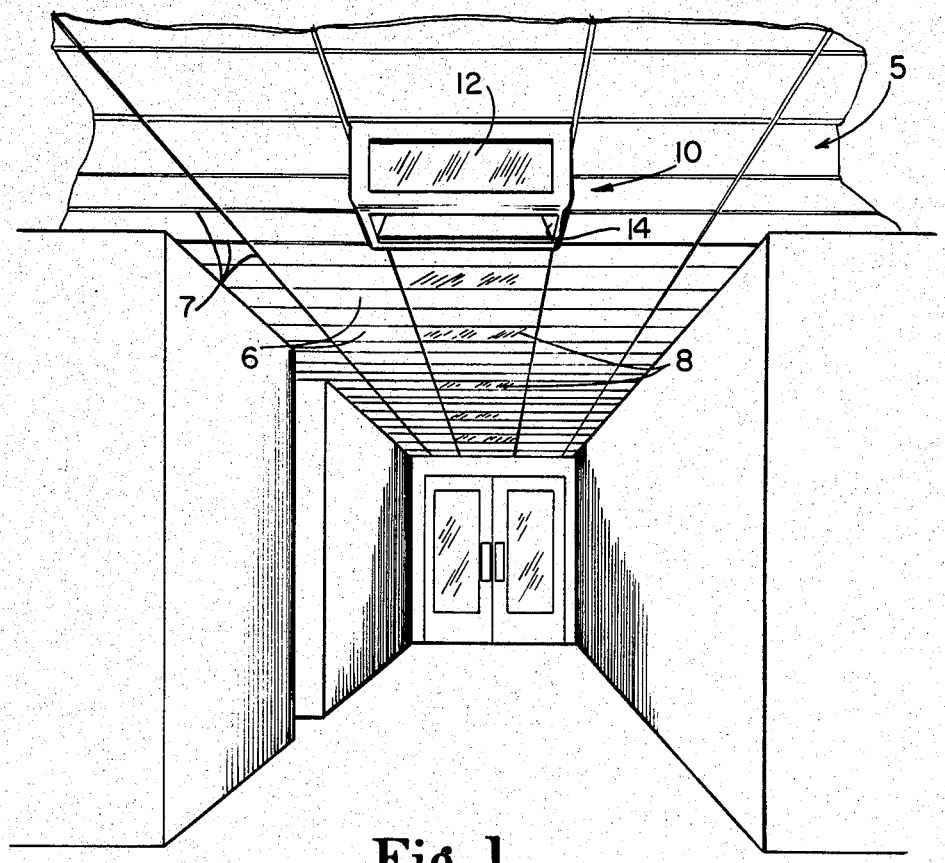
FIG. 1 is a pictorial view of a preferred embodiment of a ceiling sign according to the present invention, substitutionally fitted into a light diffuser position within a modular suspended ceiling above a corridor.

In FIG. 1, there is shown a preferred ceiling sign 10 according to the invention, as installed in a modular suspended ceiling 5 over a public corridor, for example in an office building hallway. Modular suspended ceiling 5 is constructed of a substantially regular array of acoustical ceiling panels 6 which are suspended within a correspondingly regular array of T-bar grids 7, which in turn are suspended from the building superstructure (not shown). At substantially regular intervals light diffusers 8 are substituted for ceiling panels and lay-in fluorescent light fixtures (discussed below) are placed above and on the grids in those respective locations. The suspended ceiling sign 10 is substituted for one of these diffusers under a fluorescent light source such that display indicia on translucent sign face 12 are illuminated, while relatively directed lighting is provided beneath the ceiling sign 10 through the diffuser 14 mounted in a recess within the bottom of the ceiling sign 10. Thus, the ceiling sign 10 may be simply and quickly installed in the modular ceiling so as to take advantage of existing lighting fixtures, to provide illuminated sign indicia, and to provide directed lighting beneath the ceiling sign, thereby producing an attractive lighting effect.

Figure 2:
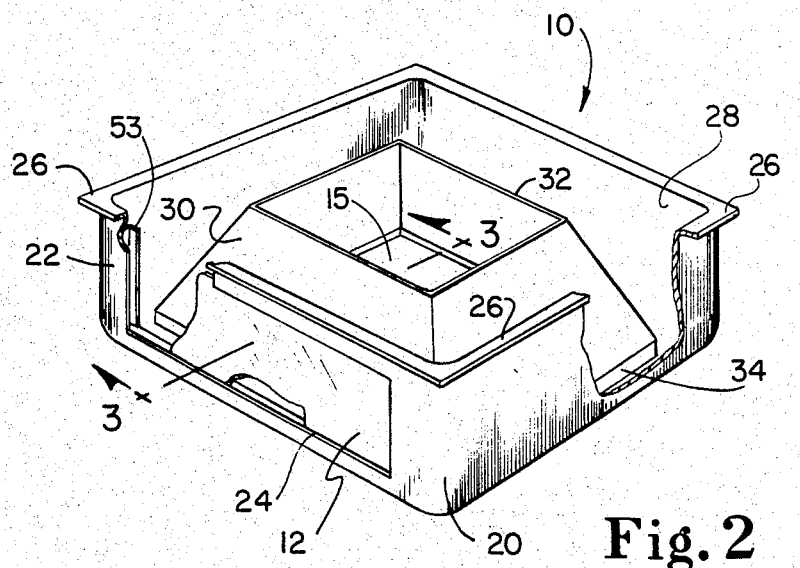
FIG. 2 is a pictorial view of the ceiling sign of FIG. 1 removed from the suspended ceiling, and shown partially broken away for illustration.
Figure 3:
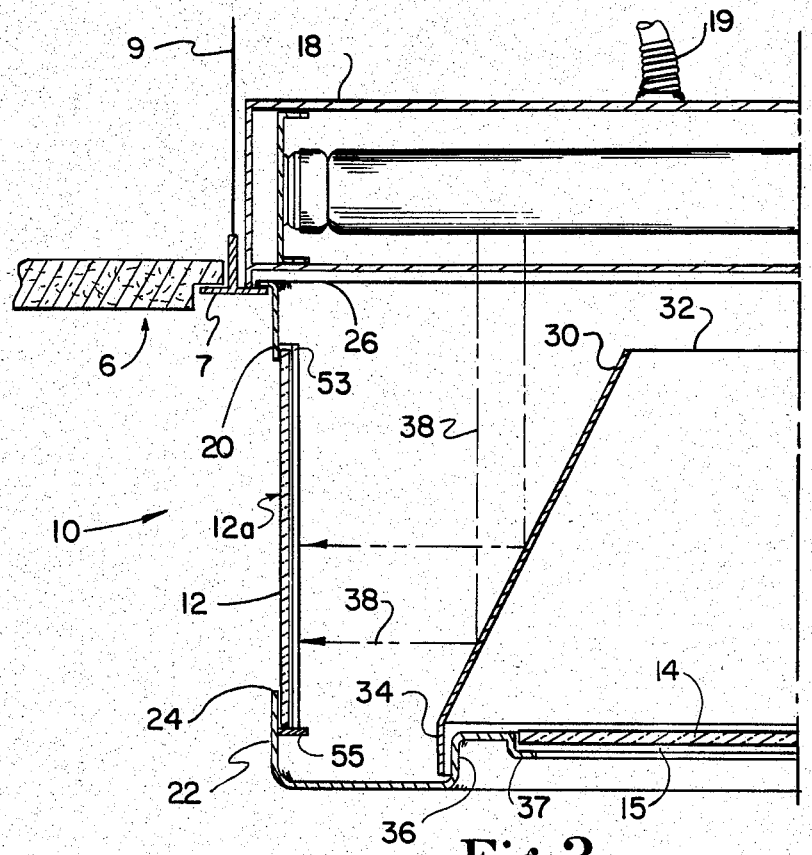
FIG. 3 is an elevation view of a vertical cross-section taken along line 3—3 of FIG. 2, centrally traversing the ceiling sign.

In FIG. 2, there is shown a pictorial view of the ceiling sign 10 removed from suspended ceiling 5, with portions of its sidewalls being cutaway. Ceiling sign 10 includes enclosure 20 having substantially vertical sidewalls such as sidewall 22. In sidewall 22, there is a display cutout 24 in which there is mounted a translucent display 12. Optionally, a translucent display could be provided in each of the sidewalls of the enclosure 20. About the open top 28 of the enclosure 20 there is provided a peripheral flange 26 which is sized to hang from the inverted T-bar grids 7 in suspended ceiling 5 immediately below an existing light fixture 18, as shown in FIG. 3. Generally, the width and length dimensions of enclosure 20 will closely correspond to the standard dimensions of the modules making up the suspended ceiling 5.

Inside the enclosure 20 is a truncated pyramidal baffle 30 which has reflective surface properties to direct light from the fixture 18 toward the translucent display 12 and which also is translucent to permit light from the fixture to diffuse through the baffle 30 to provide a directed light source through an aperture 15 in the bottom of enclosure 20 (discussed below). The truncated pyramidal baffle 30, in the embodiment shown, has an open truncated top 32 such that light traveling downward from the fixture 18 above the ceiling sign 10 passes directly through the open interior of baffle 30. Optionally, a translucent cover may be provided for the truncated top of baffle 30 which provides a way of allocating and diffusing the relative amounts of light passing through display 12 and that directed from the bottom of enclosure 20. The material from which baffle 30 is constructed is not critical and preferably is a conventional translucent plastic.

In the embodiment shown, the planar cross-section of enclosure 20 is substantially square. In this configuration, it is preferred that baffle 30 be about a 45° truncated pyramid. However, selection of the angularity of baffle 30 is another way of allocating the relative amounts of light supplied to the display sign and that supplied to the directed lighting beneath the ceiling sign 10. Generally, the base 34 of baffle 30 is shaped to correspond to the planar area of enclosure 20, e.g. when enclosure 20 has a substantially square planar area the base 34 of baffle 30 is configured as substantially square. Further, the base 34 of baffle 30 is configured to seat onto a recess in the bottom of enclosure 20, as discussed in connection with FIG. 3. It should also be understood that the plan-view shape of enclosure 20 can alternatively be an elongate rectangle to accommodate light fixtures of corresponding overall configuration.

Optionally, though not preferred, enclosure 20 could be configured as a cylinder so long as the supporting flange is relatively square to correspond to panel positions in the suspended ceiling. In that situation, display face 12 would be arcuate rather than planar as shown, and the baffle preferably would be configured as a truncated cone to correspond generally to the cylindrical shape of the ceiling sign enclosure.

In FIG. 3, there is shown a vertical cross-section of ceiling sign 10 taken in the direction of arrows 3—3 of FIG. 2, to illustrate operation of the ceiling sign. Acoustical ceiling panel 6 is shown nested on grid element 7 which is a conventional T-bar ceiling track, which in turn is suspended by wire 9 from the building superstructure (not shown). Also supported by T-bar 7 is a conventional lay-in fluorescent light fixture 18 with power supply wiring 19. The ceiling sign 10 is substituted in place of a light diffuser that would normally be under lay-in light fixture 18. Thus, flange 26 extends outwardly from the upper end of the enclosure sidewall 22 and rests on T-bar 7 to suspend the sign 10 beneath the light fixture 18.

Light traveling downwardly from the light fixture 18, as indicated at 38, strikes the inclined face of a side of pyramidal baffle 30 and is reflected horizontally toward and through translucent display assembly **12*a*. Thus, the truncated pyramidal shape of baffle 30 has a key functional aspect of enhancing illumination of display assembly 12. Further, since baffle 30 is translucent, light within enclosure 20 diffuses through the translucent baffle for emission downwardly from aperture 15 and diffuser 14 within recess 36 at the bottom of enclosure 20. Diffuser 14 seats in flange 37 peripherally formed around aperture 15. Further, light traveling downward from light fixture 4 that passes directly through the truncated top 32 (shown open) of baffle 30 will pass directly downwardly through the interior of baffle 30 to be admitted through aperture 15**.

Recess 36 serves two purposes. First, the recess serves to enhance the directedness of the directed light beneath ceiling sign 10 as admitted through aperture 15 and diffuser 14. Second, recess 36 provides a convenient means of fixing the position of baffle 30 internal of enclosure 20, in that the base 34 of baffle 30 is configured to closely seat around the perimeter of recess 36.

Display assembly **12*a* preferably may be mounted in display cutout 24 of sidewall 22 using a conventional adhesive, or as shown in FIG. 2 may be dropped into vertical channels 53 along each side of cutout 24. A stop 55 is provided at the base of the drop-in channel as shown in FIG. 3. The drop-in channels are preferably provided so that display indicia may be easily changed when the entire ceiling sign 10 is removed from the grid structure 7**.

Figure 4:
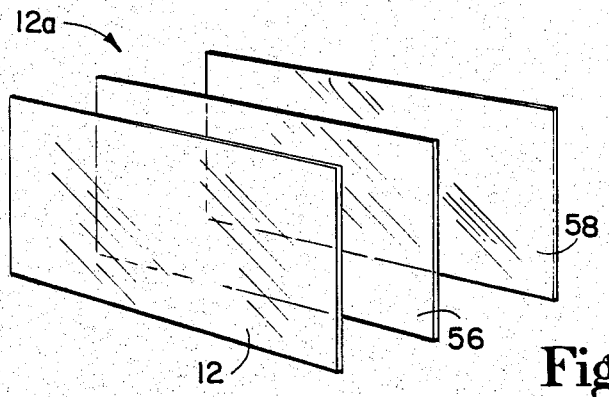
FIG. 4 is a fragmented view of the components of the sign display assembly of the foregoing ceiling sign.

In FIG. 4, an exploded view is shown of display assembly **12*a* to illustrate the convenience with which display indicia may be changed. Display assembly 12*a* has several translucent drop-in inserts. The first or innermost drop-in insert 58 is a translucent diffuser sheet, and preferably has structural rigidity sufficient to support the film negative 56 of the desired display indicia. The outermost insert 12 preferably is a transparent sheet to sandwich the film negative 56 against the diffuser sheet 58. A colored film sheet may also be sandwiched between the sheets 12 and 58 as desired. The outermost sheet 12 is the display face referred to above. Preferably, the various components selected for the display assembly are of conventional acrylic, appropriately pigmented. Thus, the display assembly 12*a*** may be quickly modified for any of a wide variety of display formats.

Although the present invention has been described in conjunction with preferred embodiments, it is to be understood that modifications and variations may be utilized without departing from the principles and scope of the invention as defined by the following claims.

I claim:

1. A suspended ceiling sign for suspension within a vacant area under a light source in a suspended ceiling, wherein ceiling panels are peripherally supported within a suspended gride structure, the sign comprising:

a hollow enclosure having an open top with a peripheral flange configured to engage the grid structure which delimits said vacant area, said enclosure having sidewalls and having a sign message support cutout in one of said sidewalls, and said enclosure having a bottom with a lighting aperture therein;

a light transmissive sign mounted in said cutout;

a reflective and translucent baffle seated inside said enclosure around and over said bottom aperture, and having at least one reflective surface positioned to receive a portion of the illumination emanating downwardly from the light source and reflect that illumination toward said sidewall message support cutout and the sign mounted therein; and said baffle having a light-transmissive top end positioned to receive another portion of the illumination emanating from the light source and to direct that other portion downwardly to exit said lighting aperture in the bottom of said enclosure, so that the suspended ceiling sign illuminates the region below the sign while also illuminating the sidewall message support means and sign mounted therein.

2. The ceiling sign of claim 1 wherein said enclosure further comprises a recess about said bottom aperture, and the base of said baffle is configured to seat about said recess and positively locate the baffle within the enclosure, thereby locating the reflective surface for proper reflection and locating the top end for proper direction.

3. The ceiling sign of claim 1 wherein the bottom of said baffle comprises a shape corresponding to the peripheral shape of the bottom of said enclosure.

4. The ceiling sign of claim 2 wherein said enclosure further comprises a recess about said aperture, seating means in said recess for seating a light diffuser in said aperture, and a light diffuser on said seating means to receive and diffuse the illumination directed downwardly through the top end of the baffle.

5. The ceiling sign of claim 4 wherein said seating means comprises a peripheral flange about said aperture.

6. The ceiling sign of claim 4 wherein said recess comprises a depth corresponding to a predetermined extent of collimation of illumination passing from said aperture.

7. The ceiling sign of claim 1, wherein:

said baffle comprises a substantially pyramidal configuration having a truncated top disposed within said enclosure in proximate relation to the light source in the ceiling;

said pyramidal configuration including at least one inclined side obliquely facing said message support cutout and comprising said reflective surface, so that illumination is reflected from the light source to the message support means; and said truncated top is light-transmissive so that illumination from the light source passes through the truncated top toward said bottom aperture in the enclosure.

8. The ceiling sign of claim 7, wherein:

said enclosure further comprises a recess around said bottom aperture; and said pyramidal baffle has a base configured to seat in said recess and thereby positively locate the baffle within the enclosure, so as to position said baffle with the inclined side in predetermined reflecting relation with said message support cutout on the enclosure sidewall, and with said light-transmissive top in predetermined alignment above the bottom aperture in the enclosure.

* * * * *